US006341736B1

(12) United States Patent
Liao

(10) Patent No.: US 6,341,736 B1
(45) Date of Patent: Jan. 29, 2002

(54) AIR BRUSH TYPE SPRAYER

(76) Inventor: Cheng Liao, No. 359, Bu-Tzu Lane, Pei-Tun Area, Taichung City (TW)

( * ) Notice: Subject to any disclaimer, the term of this patent is extended or adjusted under 35 U.S.C. 154(b) by 0 days.

(21) Appl. No.: 09/768,344

(22) Filed: Jan. 25, 2001

(51) Int. Cl.[7] ..... A62C 13/62; B05B 9/08

(52) U.S. Cl. ..... 239/375; 239/306; 239/341; 239/420; 239/426; 239/434; 239/525; 239/530; 239/DIG. 14; 285/305

(58) Field of Search ..... 239/306, 341, 239/375, 420, 426, 434, 525, 530, DIG. 14; 285/305, 319; 403/326, 329

(56) References Cited

U.S. PATENT DOCUMENTS 1,166,522 A * 1/1916 Holton
1,891,067 A * 12/1932 Spira
2,368,536 A * 1/1945 Gersmehl
2,389,864 A * 11/1945 Miller
2,820,578 A * 1/1958 Dickman
3,107,058 A * 10/1963 Corbett
4,020,990 A * 5/1977 Luff ..... 239/346
4,742,963 A * 5/1988 Marvaldi ..... 239/337
5,255,852 A * 10/1993 Morrison ..... 239/346
5,464,155 A * 11/1995 Schutter ..... 239/525

* cited by examiner

*Primary Examiner*—Robin O. Evans
(74) *Attorney, Agent, or Firm*—Rosenberg, Klein & Lee

(57) ABSTRACT

An air brush type sprayer includes a can with a base extending from the can and a liquid outlet member is threadedly connected to a top of the base. A tube connected between an interior of the can and the liquid outlet member. A nozzle assembly is connected to a compressor and a nozzle and a connection part both extend from the nozzle assembly. The connection part is snapped to the base so that the gap is easily adjusted by rotating the liquid outlet member.

4 Claims, 7 Drawing Sheets

AIR BRUSH TYPE SPRAYER

FIELD OF THE INVENTION

The present invention relates to an air brush type sprayer that has a nozzle assembly snapped to a can. A liquid outlet member is threadedly connected to a top of the can.

BACKGROUND OF THE INVENTION

A conventional air brush type sprayer for spraying colored paint, stains, lacquers and the like is shown in FIG. 5 and generally includes a can 30 for receiving liquid material therein and a cap 31 threadedly connected to a top of the can 30. The cap 31 has a threaded protrusion and a passage 311 is defined therethrough for a tube 32 extending through the passage 311 to allow a tip portion to extend from the threaded protrusion. A nozzle assembly 33 having a connection part 331 connected to the threaded protrusion and includes a nozzle 332 which is located beside the tip of the tube 32. A valve 333 is received in the nozzle 332 and can be operated by a lever 334 which is integrally connected to the nozzle assembly 33. The nozzle assembly 33 is connected to a compressor so as to blow pressurized air flow from the nozzle 332 to suck the liquid material in the can 30. When adjusting the gap between the nozzle 332 and the tip, the can 30 and the nozzle assembly 33 are both rotated in opposite direction to let the connection part 331 be moved upward relative to the threaded protrusion as shown in FIG. 6. The other way is to rotate the can 30 as shown in FIG. 7. However, both of the two ways could disengage the can 30 and the nozzle assembly 33. Because both of the two items are heavy so that the adjusting is inconvenient for the users. Besides, the lever 334 is integral with the nozzle assembly 33 so that once the lever 334 is broken, the whole nozzle assembly 33 has to be discarded.

SUMMARY OF THE INVENTION

In accordance with one aspect of the present invention, there is provided an air brush type sprayer and comprises a can with a cap mounted thereto and a base extends from the cap. A liquid outlet member is threadedly connected to a top of the base. A nozzle assembly has a valve received therein which is operated by a lever connected to the nozzle assembly. A nozzle and a connection part extend from the nozzle assembly. The connection part is connected to the base.

The primary object of the present invention is to provide an air brush type sprayer wherein the nozzle assembly is snapped on the can and the liquid outlet member is threadedly connected to a top of the can.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
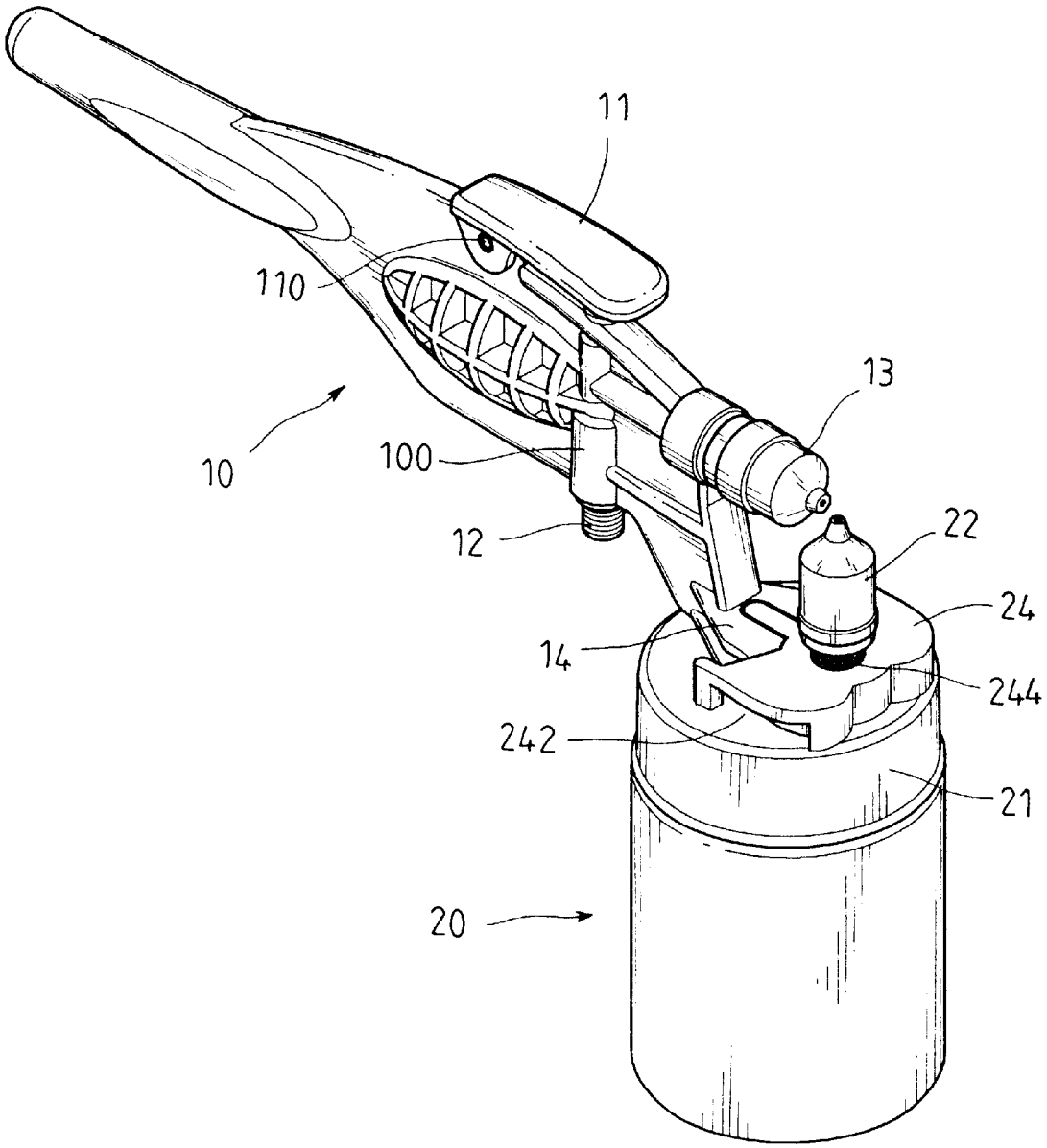
FIG. 1 is a perspective view to show the an air brush type sprayer of the present invention.
Figure 2:
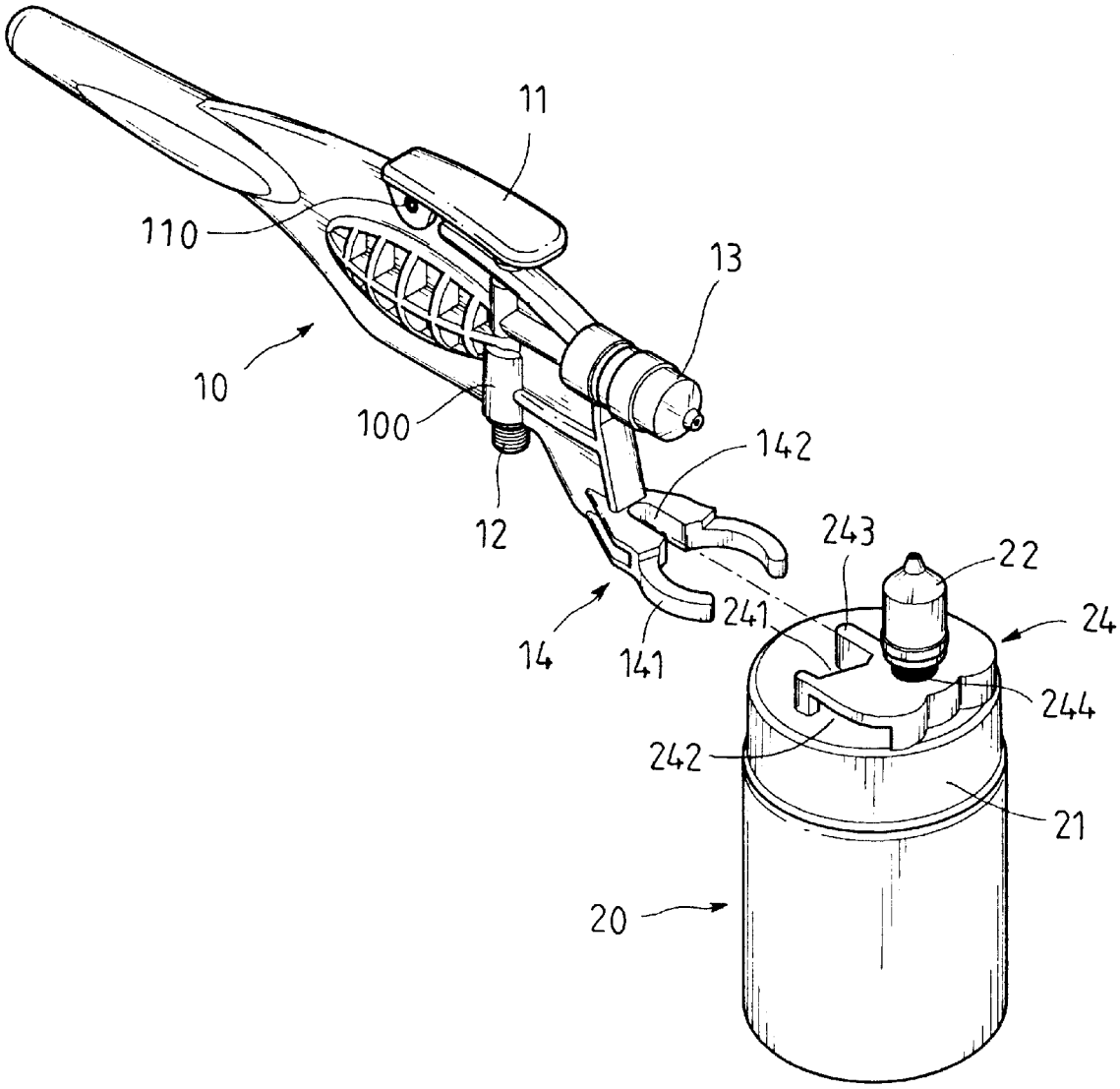
FIG. 2 is an exploded view to show the nozzle assembly and the can of the air brush type sprayer of the present invention.
Figure 3:
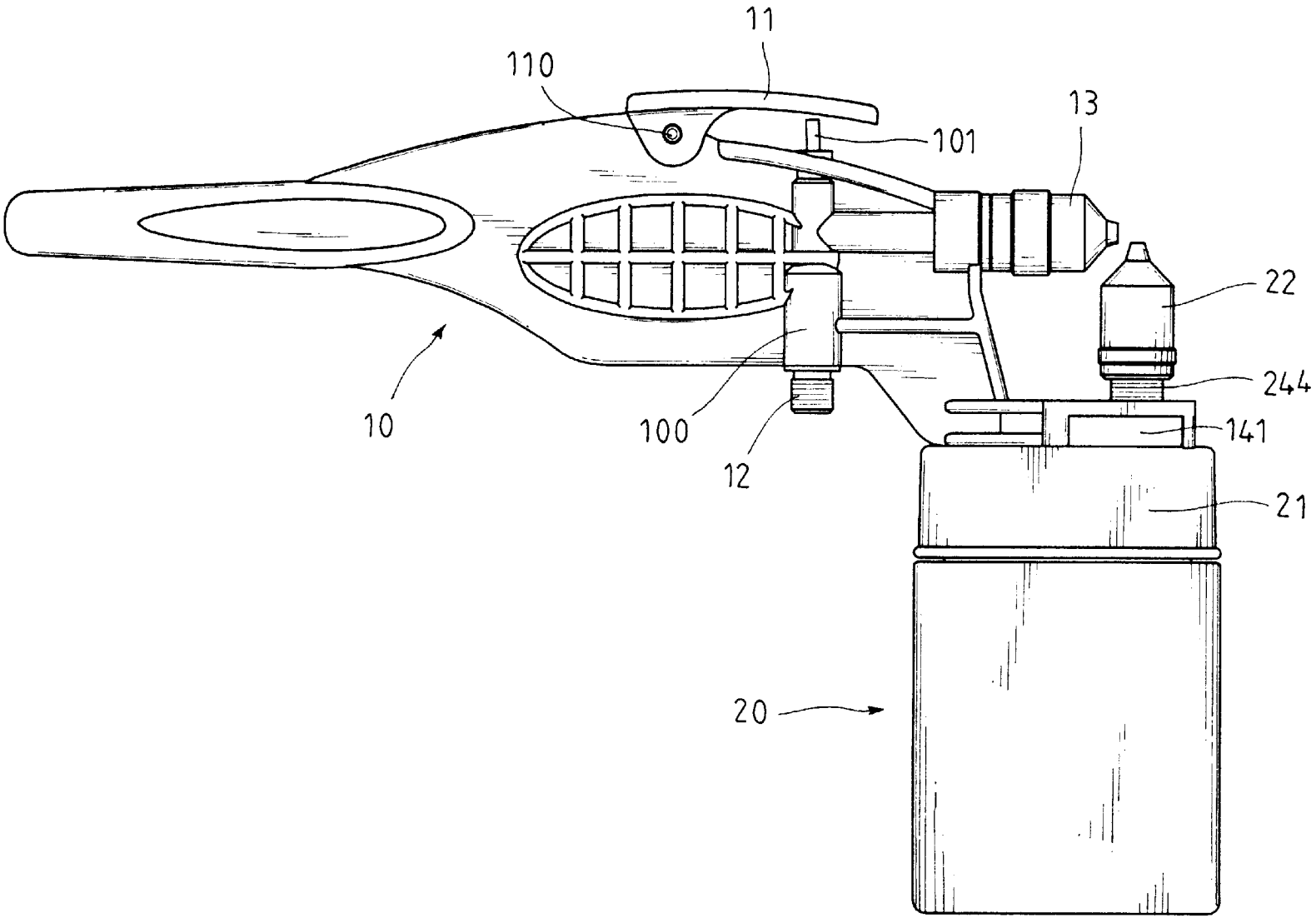
FIG. 3 is a side view to show the air brush type sprayer of the present invention.
Figure 4:
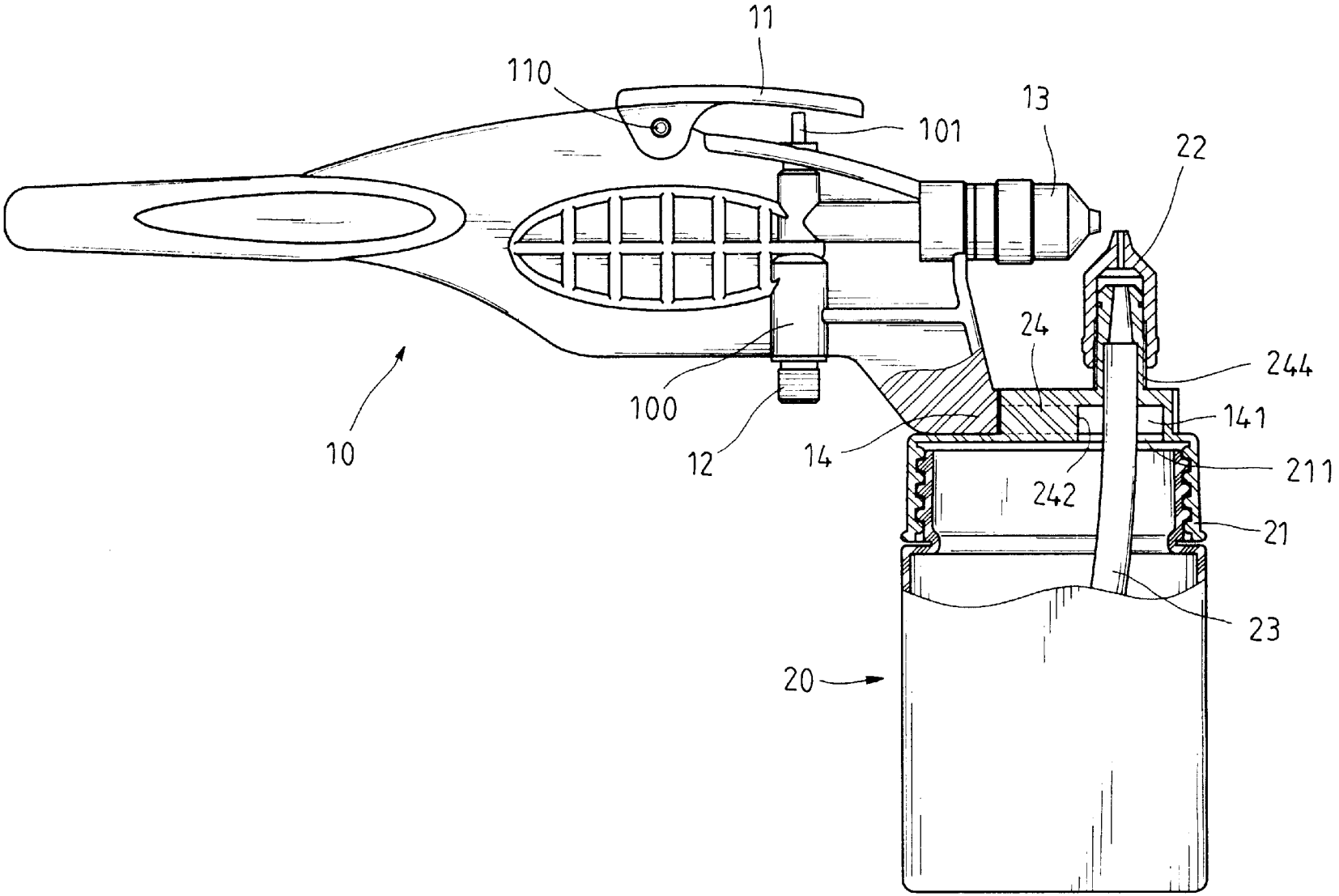
FIG. 4 is a cross sectional view to show the air brush type sprayer of the present invention.
Figure 5:
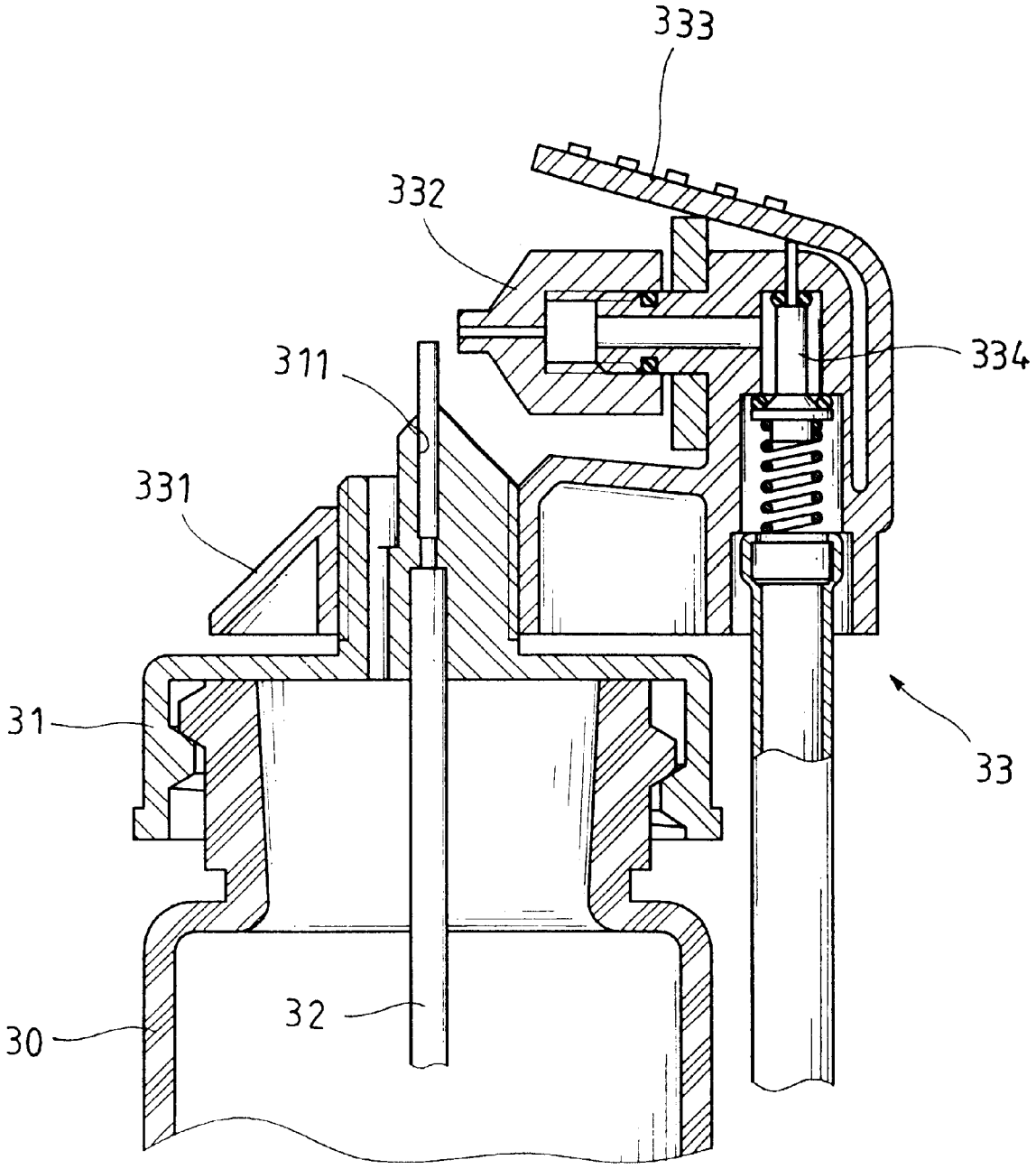
FIG.5 PRIOR ART
FIG. 5 is a cross sectional view to show a conventional air brush type sprayer.
Figure 6:
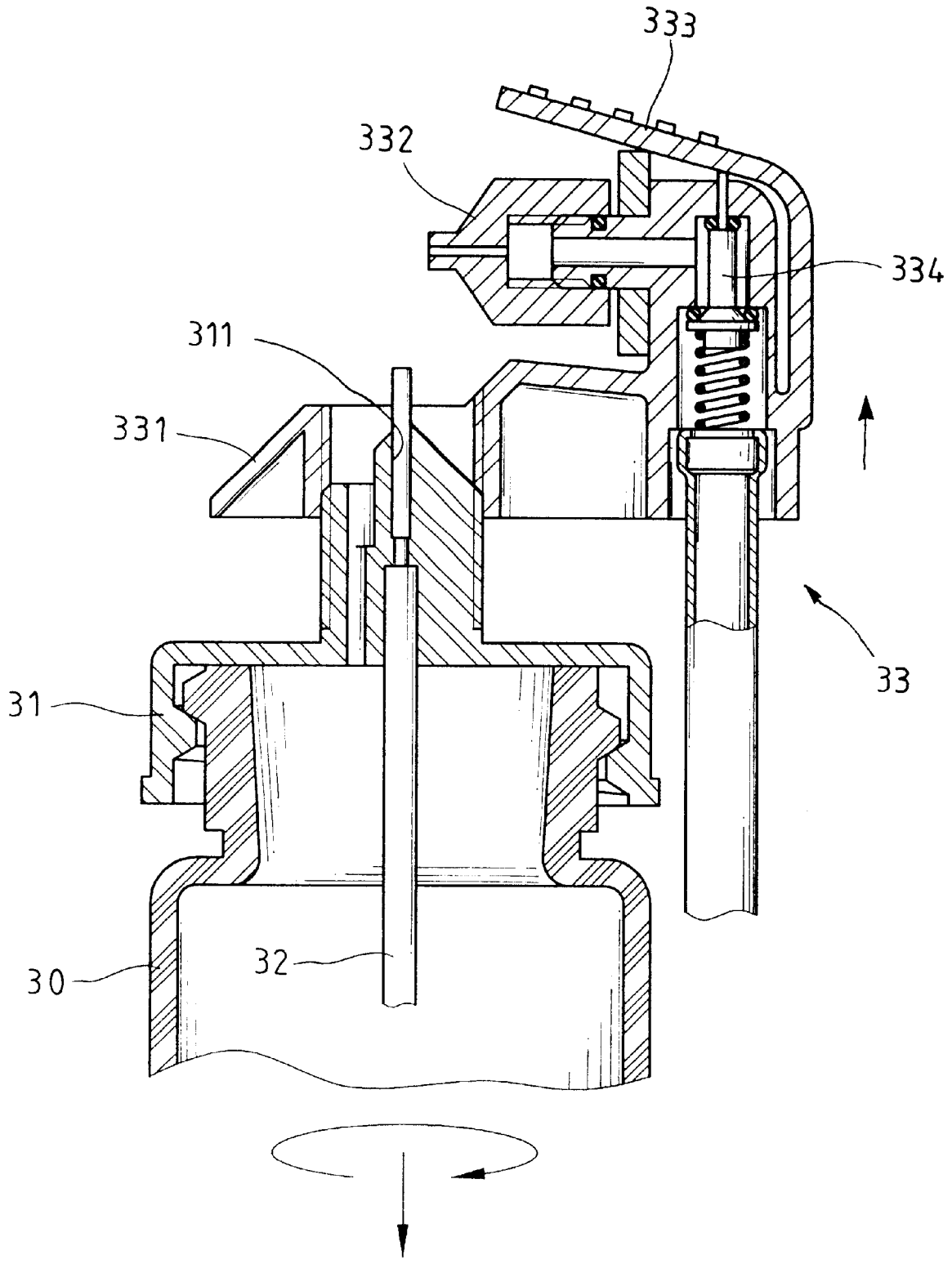
FIG.6 PRIOR ART
FIG. 6 is a cross sectional view to show the conventional nozzle assembly is rotated upward to obtain a larger gap between the tip and the nozzle of the conventional air brush type sprayer.
Figure 7:
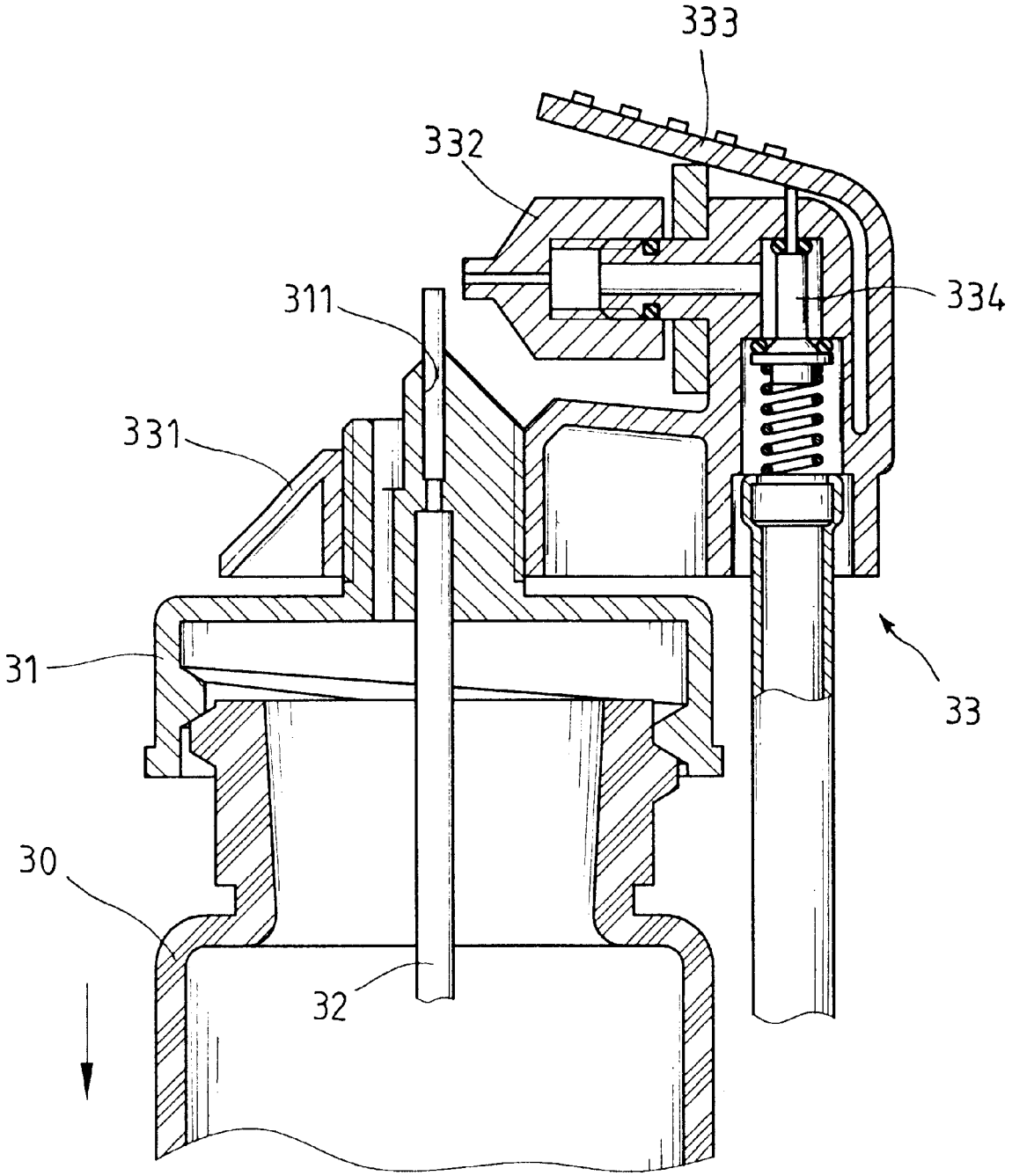
FIG.7 PRIOR ART
FIG. 7 is a cross sectional view to show the can is rotated downward to adjust the gap between the tip and the nozzle of the conventional air brush type sprayer.

Referring to FIGS. 1 to 4, the air brush type sprayer of the present invention comprises a can 20 with a cap 21 mounted to a top of the can 20 and a base 24 extends from the cap 21. A threaded tube 244 extends from the base 24 and a tube 23 communicating with an interior of the can 20 is engaged with the threaded tube 244. The liquid outlet member 22 is threadedly connected to the threaded tube 244. A guide member 243 extends from the base 24 and two holes 241 are respectively defined in the base 24 and separated by the guide member 243. Two apertures 242 are defined in two sides of the base 24 and communicate with the two holes 241.

A nozzle assembly 10 has a valve 100 received therein and a rod 101 of the valve 100 extends from the nozzle assembly 10. A lever 11 is pivotally connected to the nozzle assembly 10 by a pin 110 and located above the rod 101. A fitting 12 is connected to a lower end of the valve 100 so as to be connected to a compressor (not shown). A nozzle 13 and a connection part 14 both extend from the nozzle assembly 10. The connection part 14 has two pawls 141 extending therefrom and a groove 142 is defined in the connection part 14. The two pawls 141 are engaged with the two holes 241 in the base 24 and the guide member 243 is received in the groove 142. The engagement of the guide member 243 and the groove 142 prevents the nozzle assembly 10 from rotating relative to the can 20. The two pawls 141 are easily snapped to the base 24 when assembling the two items.

The gap between a tip of the liquid outlet member 22 and the nozzle 13 is simply to rotate the liquid outlet member 22. This is convenient for the user because the liquid outlet member 22 is light in weight.

While we have shown and described various embodiments in accordance with the present invention, it should be clear to those skilled in the art that further embodiments may be made without departing from the scope and spirit of the present invention.

What is claimed is:

1. An air brush sprayer comprising:

a can with a cap mounted thereto and a base extending from said cap, a liquid outlet member threadedly connected to a top of said base, a guide member extending from said base, two holes respectively defined in said base and separated by said guide member; and a nozzle assembly having a valve received therein and a rod of said valve extending from)m said nozzle assembly, a lever connected to said nozzle assembly and located above said rod, a nozzle and a connection part extending from said nozzle assembly, said connection part connected to said base, two pawls extending from said connection part and respectively engaged with said two holes of said base, a groove defined in said connection part to receive said guide member of said base therein.

2. The sprayer as claimed in claim 1 further comprising two apertures defined in two sides of said base and communicating with said two holes.

3. The sprayer as claimed in claim 1 further comprising a threaded tube extending from said base and a tube in said can being engaged with said threaded tube, said liquid outlet member threadedly connected to said threaded tube.

4. The sprayer as claimed in claim 1 wherein said lever is pivotally connected to said nozzle assembly by a pin.

* * * * *